US005358326A

United States Patent [19]

Cherry et al.

[11] Patent Number: 5,358,326

[45] Date of Patent: Oct. 25, 1994

[54] REFRIGERATOR WITH IMPROVED DOOR FRONT AND HANDLE ATTACHMENT

[75] Inventors: David N. Cherry; Donald G. Falk, both of Louisville, Ky.

[73] Assignee: General Electric Company, Louisville, Ky.

[21] Appl. No.: 4,715

[22] Filed: Jan. 14, 1993

[51] Int. Cl.[5] ..... A47B 95/02

[52] U.S. Cl. ..... 312/405; 312/265.6

[58] Field of Search ..... 312/257.1, 108, 265.5, 312/265.6, 405; 16/110 R, 111 R, 125

[56] References Cited

U.S. PATENT DOCUMENTS

| | | | |
|---|---|---|---|
| 4,087,141 | 5/1978 | Roberts | 16/110 R X |
| 4,900,109 | 2/1990 | Boston, Jr. et al. | 312/276 |
| 4,948,206 | 8/1990 | Fitzpatrick | 312/214 |

*Primary Examiner*—Kenneth J. Dorner
*Assistant Examiner*—Nancy Mulcare
*Attorney, Agent, or Firm*—H. Neil Houser

[57] ABSTRACT

A refrigerator includes a refrigerated compartment with an access opening and a door mounted to selectively close the opening. The door includes vertically extending front and side walls. An elongated support member is removably mounted to each side wall by screws which extend through the side walls and are received in elongated stiffening members inside the door. A decorative cover overlies the front wall of the door and is removably secured to each support member. A handle is mounted to the front of the cover by screws which support the handle and cover from one of the support members.

11 Claims, 2 Drawing Sheets

REFRIGERATOR WITH IMPROVED DOOR FRONT AND HANDLE ATTACHMENT

BACKGROUND OF THE INVENTION

It has become popular for consumers to customize their refrigerators by using decorative covers which match or harmonize with the decor of their kitchens. For example, many consumers desire that the front of the refrigerator be the same material as their kitchen cabinets. Many cabinet doors are made from materials which are about one quarter inch thick while other, more expensive, cabinet doors may be constructed from material as much as about three quarters of an inch thick. This raises the need for flexible mounting arrangements, particularly with refrigerators which are designed to be "counter depth", that is to have the front of the refrigerator essentially even with the front of the adjacent kitchen counters and cabinets.

An additional design difficulty with such refrigerators relates to door handles. Typically a manufacturer will manufacture its refrigerators with one of only a few models of handles. In addition, many of these handles are mounted to the front of the doors. This greatly complicates the use of custom door fronts. Some manufacturers attack this problem by making the handle part of a plate or flange which is attached to the side wall or edge of the door. While this alleviates to some degree problems in customizing the door covers, such handles often are not good aesthetic matches for the up-scale decorative fronts some consumers want to put on their refrigerators.

It is an object of this invention to provide a refrigerator including an improved arrangement for selectively mounting a decorative cover on the doors, including mounting of selected handles.

It is another object to provide such an arrangement which simplifies the use of decorative covers of different thicknesses, It is still another object to provide such an arrangement which is flexible in use while minimizing the number of required parts,

SUMMARY OF THE INVENTION

In accordance with one embodiment of the invention a refrigerator includes a refrigerated compartment having an access opening and a door mounted for pivotal movement to selectively close the access opening. The door includes vertically disposed front and side walls, An elongated support member is removably mounted to each side wall of the door. A decorative cover is removably secured to the support members in overlying juxtaposition of the door front wall. A handle is removably mounted on the cover in a position overlying a portion of a o predetermined one of the support members.

DESCRIPTION OF THE PREFERRED EMBODIMENTS

Figure 1:
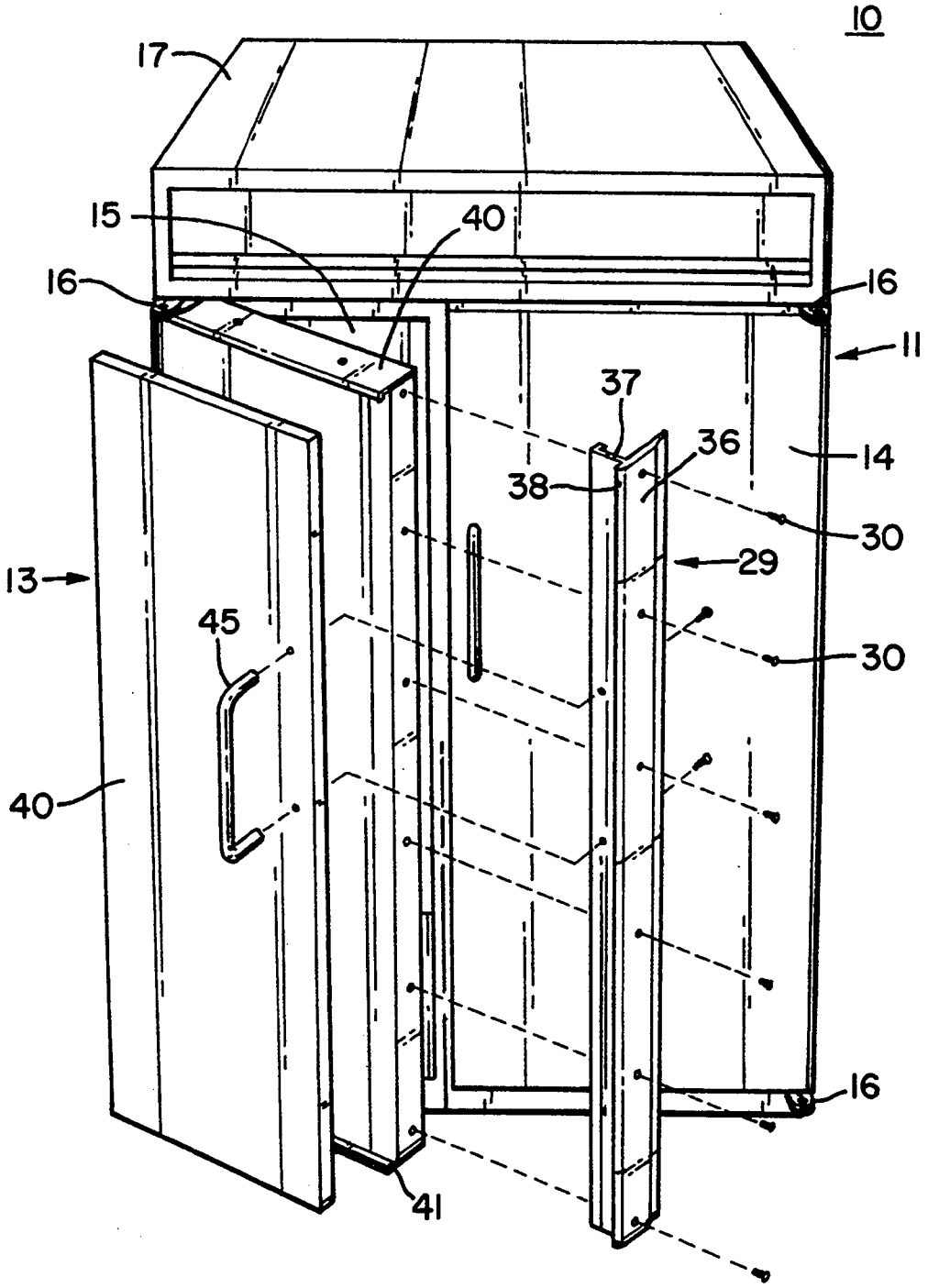
FIG. 1 is a simplified perspective view of a refrigerator incorporating one embodiment of the present invention.

Referring particularly to FIG. 1, there is shown a refrigerator 10 of the side-by-side refrigerator/freezer type. The refrigerator 10 includes an outer cabinet 11 which is divided into a fresh food compartment (not shown) and freezer compartment 12. A pair of doors 13, 14 are mounted on hinges 16 to pivot about their outer vertical edges to selectively close the compartments and provide access through compartment front openings, such as that shown at 15 for freezer compartment 13. Such refrigerators typically include machinery compartments for the equipment which provides the refrigeration. In the illustrative refrigerator the machinery compartment 17 is positioned above the freezer and fresh food compartments.

Figure 2:
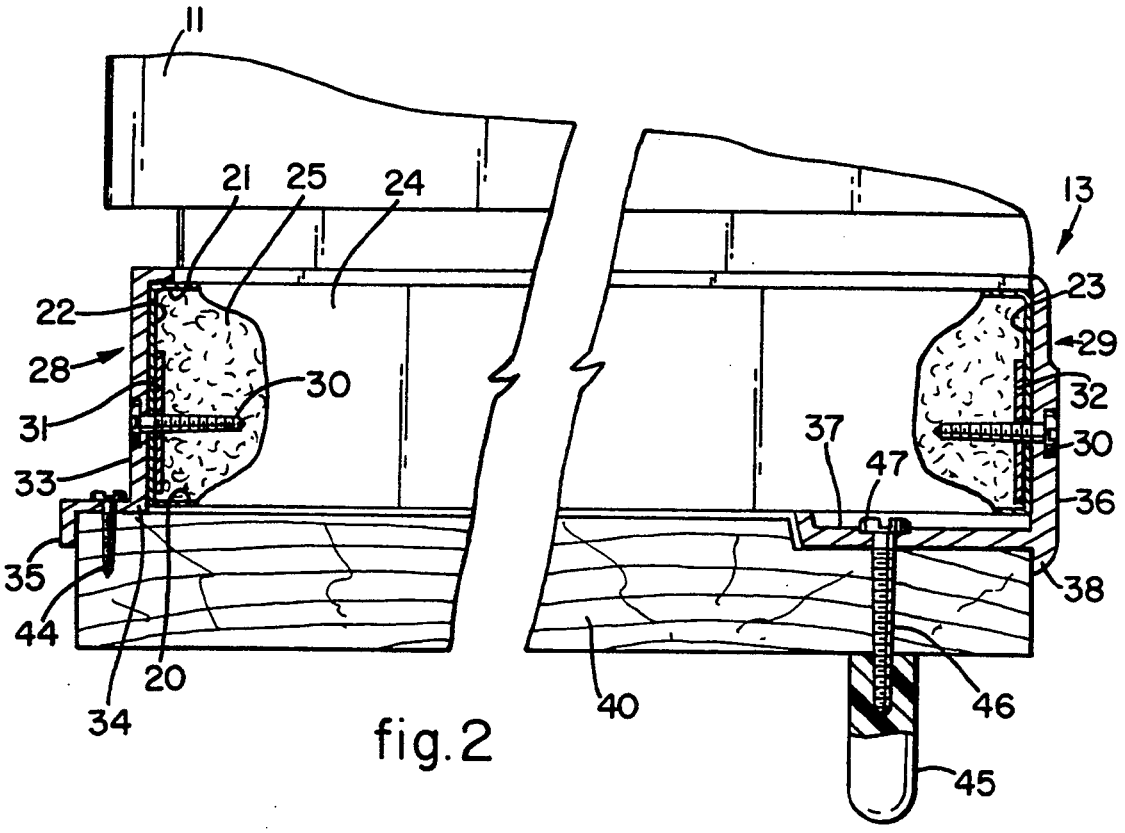
FIG. 2 is a plan view of the left hand door of the refrigerator of FIG. 1, partly in section and with some portions removed for purposes of illustration.

For simplicity's sake, the illustrative embodiments will be described in connection with the left hand (freezer) door of the refrigerator shown in FIG. 1. However, it will be understood that the present invention is equally applicable to doors of refrigerators of various configurations; such as either a freezer door or a fresh food door of a side-by-side refrigerator as shown, the door of a single door refrigerator and the doors of top mount refrigerators. Referring now to FIGS. 1 and 2, the door 13 includes a front or outer wall 20, a rear or inner wall 21 and side walls 22, 23, all of which are generally vertical. There also is a horizontal top wall 24 and bottom wall, not shown. For simplicity the door has been illustrated as a simple box formed of one material. It will be understood that normally all but the rear wall are formed from a folded sheet of suitable material, such as steel, and the rear wall is formed of a plastic material molded to include storage shelves and the like. The interior of the door is filled with an insulation material, conveniently a foamed in situ resin 25.

Support members 28, 29 are removably mounted to the door side walls 22, 23 respectively by a suitable means such as screws 30 which pass through the members 28, 29 and are secured in the door 13. Since the door shell (walls 20–24) and foamed insulation are an unitary self-supporting structure, the door walls normally are made from a rather thin sheet of material. In order to provide suitable support for the decorative cover and the handle, a pair of stiffening members 31, 32 may be attached to the inside surface of the side walls 22, 23 respectively and the screws 30 are threaded through the stiffening members. The support member includes a main body portion 33, which lies against the side wall 22, a flange 34, which projects outwardly of the door parallel to the door front wall 20, and a lip 35, which projects forward of the outer edge of the flange 34. The support member 23 includes a main body portion 36, which lies against the door side wall 23, a flange 37, which overlies and is parallel to the door front wall 20, and a lip which projects forward of the junction of the main body 36 and flange 37. The flange 37 is spaced slightly in front of the front wall 20, as will be discussed in more detail subsequently.

A decorative cover 40 is positioned on the flanges 34, 37. Conveniently it may be a sheet of material which is the same as or complimentary to the material of the cabinets in the kitchen in which the refrigerator will be used and the cover fits closely within the lips 35, 38. In addition decorative top and bottom members 40, 41 are mounted to the door 13 (see FIG. 1) and closely overlie the top and bottom edges of the cover 40. In this way the door presents an appearance which is in harmony with the surrounding cabinets.

Conveniently screws 44 are inserted through openings in the flange 34 and threaded into the cover 40 to removably secure the cover to support member 28. A handle 45 is positioned to the front of the cover 40 in alignment with the flange 37. Screws 46 pass through the flange 37 and cover 40 and are threaded into the handle 45. The screw heads 47 are positioned on the opposite side of the flange 37 from the handle so that the screws both removably mount the handle against the cover and removably secure the cover 40 to the flange. Additional screws 44 may be used to further secure the cover 40 to the flange 37 if desired. Other means may be used to removably secure the cover and handle. For example other threaded members, like bolts, may be mounted in the handle and secured on the opposite side of the flange 37 with washers and nuts or threaded elements could be mounted in the handle to receive bolts rather than the screws. It will be understood that the flange 37 is offset in front of the door wall 20 and the corresponding portion of the cover 40 is milled away so that the thickest cover can conveniently be used with a counter depth refrigerator.

Figure 3:
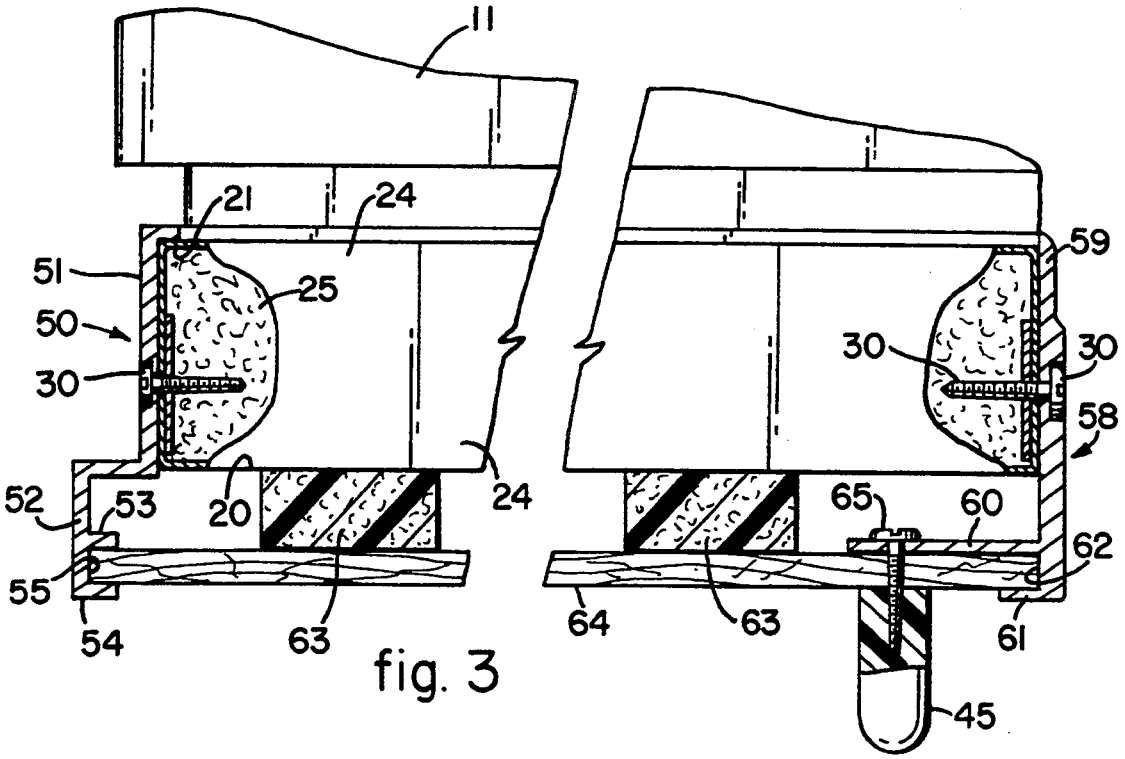
FIG. 3 is a plan view of a refrigerator door similar to FIG. 2 but illustrating another embodiment of the present invention.

Referring now to FIG. 3, there is shown an arrangement incorporating the present invention and intended for use with a thinner cover, for example a quarter inch sheet of wood, in a refrigerator designed to be counter depth. The basic refrigerator and door structure is the same as in FIGS. 1 and 2 and the same numerals have been used to identify identical parts. A support member 50 includes a main body portion 51, which lies against the side wall 22, a flange 52, which projects forward of the door and includes a pair of inwardly projecting lips 53, 54, which form a channel 55 facing the opposite support member 58. The support member 58 includes a main body portion 59, which lies against the door side wall 23, a flange 60, which overlies and is parallel to the door front wall 20, and a lip 61, which also projects inwardly over the door to form a channel with the flange.

A front cover 64 is received in the channels 55, 62 so as to overlie the door front wall 20. The channels are spaced forward of the front wall 20 so that the front of the cover will be flush with the adjacent cabinets, even though the cover 64 is thin. Spacers, such as foam strips 63, are mounted between the cover 64 and the door front wall 20 and support the central portion of the cover. The handle 45 is mounted against the cover 64 by screws 65 which pass through flange 60 and cover 64 and are threaded into the handle. As described with regard to FIG. 2, other forms of attachment members may be used in place of screws 65. It will be understood that, while a simple U-shaped handle has been illustrated, the present invention is useful with handles of any number of shapes. Also, while the illustrative embodiments provide flexibility in mounting decorative covers and handles on "counter depth" refrigerators, various modifications may be made within the spirit and scope of the invention, particularly if the refrigerator is not intended to be counter depth. For example, with a thin cover, there would be no need to space the channels forward of the door front wall.

What we claim as new is:

1. A refrigerator including:

a refrigerated compartment having an access opening;

a door mounted for pivotal movement to selectively close said access opening; said door including a vertically extending front wall bounded by a pair of spaced apart, vertically extending side walls;

a pair of elongated support members, each of said support members being removably mounted to a corresponding door side wall;

a decorative cover removably secured to said support members in overlying juxtaposition to said door front wall;

a handle; and means removably mounting said handle on said cover in a position overlying a portion of the corresponding one of said support members; said means removably mounting said handle including elongated threaded shafts secured in said handle and extending through said cover and said portion of said corresponding support member.

2. A refrigerator as set forth in claim 1, wherein:

said means removably mounting said handle further includes head means overlying the side of said portion of said corresponding support member opposite said handle to hold said handle against said cover.

3. A refrigerator as set forth in claim 1, wherein:

said means removably mounting said cover includes at least two attachment members having heads and elongated threaded shafts; each of said attachment members extending through said portion of said corresponding support member and said cover and threaded in said handle with said head tight against the opposite side of said support member.

4. A refrigerator as set forth in claim 3, wherein:

said attachment members are screws.

5. A refrigerator as set forth in claim 1, further including: a stiffening member positioned adjacent the inner surface of each of said door side walls; and a plurality of elements engaging each of said support members, passing through the corresponding side wall and having a threaded engagement with the corresponding stiffening member.

6. A refrigerator as set forth in claim 1, wherein:

one of said support members includes a channel opening toward said other support member and said other support member includes a flange extending parallel to the front wall of said door;

one edge portion of said cover is received in said channel and the opposite edge portion of said cover overlies said flange; and at least two attachment members having heads and elongated threaded shafts; each of said attachment members extending through said flange and said cover and threaded in said handle with said head tight against the opposite side of said flange.

7. A refrigerator as set forth in claim 6, wherein:

said attachment members are screws.

8. A refrigerator as set forth in claim 1, wherein:

each of said support members includes a flange extending parallel to said front of said door;

said cover is positioned aainst each of said flanges and means releasably secures said cover to each of said flanges;

said means releasably securing said cover to one of said flanges includes elongated threaded shafts which are secured in said handle and extend through said cover and said flange.

9. A refrigerator as set forth in claim 8, wherein:

head means associated with said shafts secured in said handles overlie the opposite side of the corresponding flange to hold said handle against said cover.

10. A refrigerator as set forth in claim 8, wherein:

said means releasably securing said cover to said flanges includes at least two attachment members having heads and elongated threaded shafts; each of said attachment members extending through one of said flanges and said cover and threaded in said handle with said head tight against the opposite side of said one flange.

11. A refrigerator set forth in claim 10, wherein:

said attachment members are screws.

* * * * *